United States Patent [19]

Kalra et al.

[11] Patent Number: 4,929,921

[45] Date of Patent: May 29, 1990

[54] AUTOMATABLE FUSE

[75] Inventors: Varinder K. Kalra, Chesterfield; Keith A. Spalding, Fenton, both of Mo.

[73] Assignee: Cooper Industries, Inc., Houston, Tex.

[21] Appl. No.: 324,474

[22] Filed: Mar. 16, 1989

[51] Int. Cl.[5] ..... H01H 85/16

[52] U.S. Cl. ..... 337/233; 337/231; 337/232

[58] Field of Search ..... 337/233, 232, 231, 229, 337/228, 227, 234, 248, 252, 263

[56] References Cited

U.S. PATENT DOCUMENTS

| | | | |
|---|---|---|---|
| 2,576,405 | 11/1951 | McAlister | 337/233 |
| 3,348,007 | 10/1967 | Urani | 337/232 |
| 3,568,122 | 3/1971 | Urani | 337/231 |

*Primary Examiner*—H. Broome

*Attorney, Agent, or Firm*—Donald J. Verplancken; David A. Rose

[57] ABSTRACT

A method of manufacturing a fuse includes wrapping the fuse element on an insulating bridge. The ends of the bridge include a metal foil coating which helps increase the conductivity and reliability of the solder bond between the fuse element and end ferrule.

25 Claims, 2 Drawing Sheets

AUTOMATABLE FUSE

BACKGROUND OF THE INVENTION

This invention pertains to the field of wire element fuses, and more particularly to low-to-medium-amperage wire element fuses and methods of making same.

Wire element fuses include a hollow fiber or other insulative housing, normally having a cylindrical shape, with conductive metal ferrules connected to the opposed ends of the housing. A fuse element or wire is strung between the opposed ferrules and held in place with a solder junction between the wire and the opposed ferrules. The amperage rating of the fuse is related to the diameter of the fuse wire. The smaller the diameter of the fuse wire, the less current which will flow therethrough before causing the wire to melt open, thereby opening the electrical circuit and thus isolating the faulty components and protecting the connected equipment from damage. The fuse opening rating is based on the amperage which is sufficient to open the fuse and is established by its characteristics. Under normal operating conditions, the fuse should carry its rated current uninterrupted.

Very small amperage fuses rated to continuously carry one-half to one-sixteenth of an amp typically use fuse wires with diameters from about 0.0015 to 0.00035 inches. To manufacture fuses with these small wires, end ferrules having small holes therein are crimped, press-fit, glued, or mechanically held by other suitable means to the ends of the housing. The fuse element is then threaded on a needle through the hole in one ferrule, through the insulative housing, and through the hole in the other opposed ferrule, and soldered by hand to the outside of the end ferrule. This procedure is followed because the fuse element has insufficient rigidity to span the insulative housing unless the fuse element is held in tension.

Larger fuses, designed to continuously carry one-half ampere and above, use fuse wires with diameters of about 0.0015 inches and higher. To manufacture fuses in this amperage rating range, a pair of washers are employed which are located on the ends of the fuse housing. The first washer is placed on the end of the housing, and a fuse wire is placed through the inner diameter of the washer until it extends out the other end of the housing. The fuse wire is bent over the top of the first washer and over the side of the fuse housing. An end ferrule is then forced over the end of the housing, washer, and fuse wire. Interference between the fuse wire, housing, and end ferrule helps maintain the ferrule in place. Arc quenching fillers which include but are not limited to materials such as silica, calcium carbonates, aluminum sulfates, and calcium sulfates are placed in the housing. A washer is then placed over the fuse wire extending out of the other end of the housing, and the extending fuse wire is bent over the washer and end of the housing. A ferrule is then interferingly engaged over the washer, fuse wire, and housing end. The assembly is then heated to reflow the solder which is pre-melted into the ferrules and create a solder junction between the ferrules and the fuse wire.

The manufacture of fuses is expensive and labor intensive. The threading and soldering operations are typically performed by hand, which results in an expensive product. Likewise, the use of washers in the manufacture of fuses is time consuming, as numerous manufacturing steps must be performed on the wire. Further, the small size of the wire results in a small contact area for the wire-ferrule solder interface, which may lead to detrimental fuse performance.

SUMMARY OF THE INVENTION

The present invention is a fuse having the fuse wire disposed on an insulative bridge which spans the gap between the ferrules. The bridge has a piece of conductive foil at each of its ends which helps increase the surface available for soldering the wire and thus gives an improved and reliable fuse wire-ferrule interface.

The improved construction permits easy assembly. The insulative bridge is manufactured from a roll of insulative stock which is punched out to create a bridge. A piece of conductive foil tape is applied at each edge of the strip corresponding to the edges of the bridge. The wire is then placed on the stock by an automatic winding machine and is secured in place by glue, adhesive tape or by any other suitable means. The excess wire on the back side of the bridge is cut and removed. The individual insulative bridges are then punched from the roll of wire wrapped, foiled, and taped insulative stock. These are then dropped into the insulated housing and soldered to the ferrules, one at each end.

Since almost the entire assembly can be automated, the fuses can be produced substantially cheaper. Further, since the wire is placed over the conductive tape, and the conductive tape pulls a portion of the solder away from the ferrule, a more reliable solder connection results.

These and other objects and advantages will become apparent from the following description and accompanying drawings.

BRIEF DESCRIPTION OF THE DRAWINGS

For a detailed description of a preferred embodiment of the invention, reference will now be made to the accompanying drawings, wherein.

BRIEF DESCRIPTION OF THE PREFERRED EMBODIMENT

Figure 1:
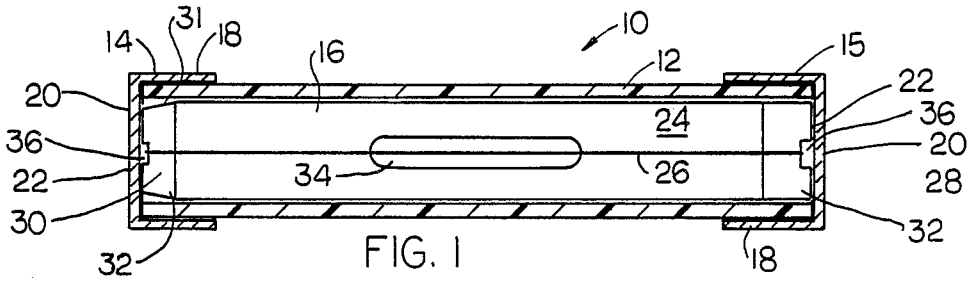
FIG. 1 is a section view of a fuse of the present invention.

Referring initially to FIG. 1, fuse 10 includes a cylindrical insulative housing or body 12 having conductive end ferrules 14, 15 disposed on opposite ends thereof and fuse bridge 16 located therein. Insulative body 12 is preferably cut from a length of glass, fiber, melamine, or any other suitable tubing. Conductive end ferrules 14,15 are preferably constructed of brass or other copper alloy, and are sized to fit around the outer diameter of insulative body 12. End ferrules 14, 15 preferably have a cylindrical wall 18 and a face 20. Other end caps or ferrule configurations, such as blade terminals, may be used without deviating from the scope of the invention. The inner surface of face 20 preferably contains a layer of flux and solder 22 therein prior to assembly of ferrules 14, 15 onto the ends of insulative body 12. The flux helps maintain ferrules 14,15 on insulative body 12 during assembly. However, other suitable means to maintain ferrules can be used.

Figure 2:
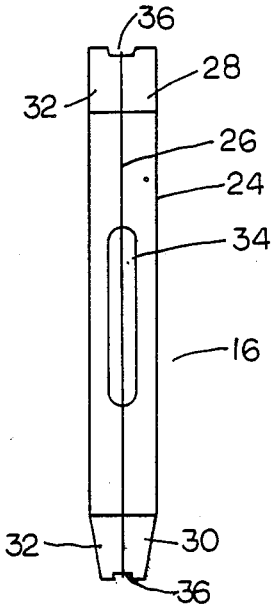
FIG. 2 is a front view of the bridge assembly of the fuse shown in FIG. 1.
Figure 6:
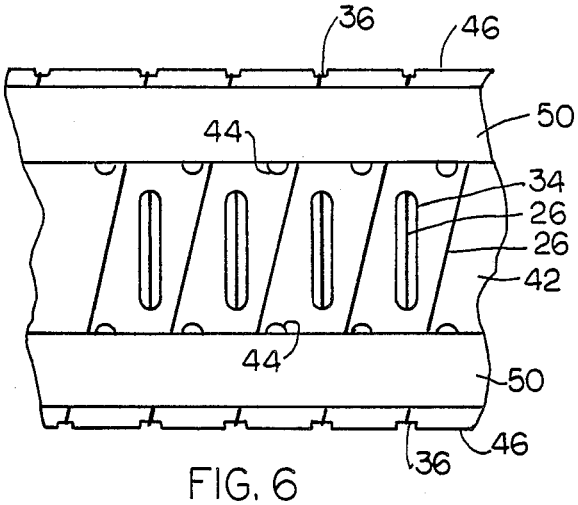
FIG. 6 is a rear view of the bridge strip board of FIG. 5 with the adhesive tape applied.
Figure 7:
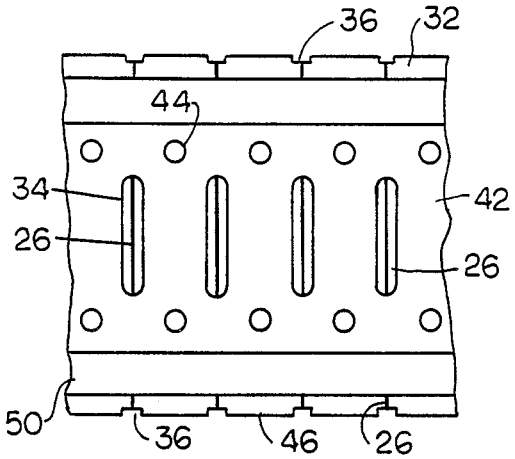
FIG. 7 is a rear view of the bridge strip board of FIG. 6 with the adhesive tape sliced and the excess wire removed.
Figure 9:
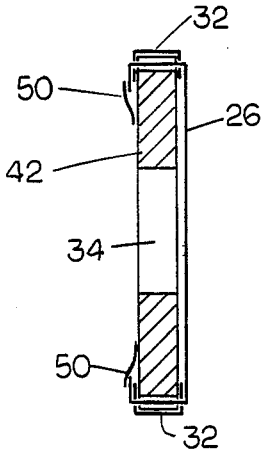
FIG. 9 is a section view of the bridge strip board of FIG. 8 at section 9—9.

Referring now to FIGS. 1 and 2, fuse bridge 16 has a bridge portion 24, preferably manufactured from an electrically insulative material which supports a fusing link 26 thereon. Bridge portion 24 may be manufactured from fiber, vulcanized fiber, ceramic, glass, melamine, paper or other insulative materials. Bridge portion 24 is a thin rectangular section, the ends 28, 30 of which are wrapped with a metal foil 32, preferably a thin copper foil. Other conductive metal foils may also be employed, or the ends of the insulative material may be pre-coated with metallic tape, a thin metallic or other conductive film, or other material which will bond to solder. Metal foil 32 is folded over the ends 28, 30 of bridge portion 24. Metal foil 32 preferably has a pressure-sensitive adhesive 31 backing, such that when metal foil 32 is located over ends 28, 30, pressure applied to the portions of metal foil 32 folded over the sides of ends 28, 30 will cause the adhesive 31 to bond the tape to the fuse bridge portion 24. End 28 is rectangular, and end 30 has chamfered side 31 which aids in the assembly of fuse bridge 16 into insulative body 12. A longitudinal fusing gap 34 is disposed through bridge portion 24, over which fusing link 26 is disposed. Longitudinal fusing gap 34 preferably extends through bridge portion 24. However, the gap may be a recess disposed in the bridge portion 24 by coining or other means. Fusing gap 34 is located to permit the area of fusing link 26 most likely to melt during circuit overload conditions to be free of adjacent materials which would form a heat sink and thereby alter the fusing characteristics. Ends 28, 30 further include a notch 36, across which fusing link 26 is bent. Fusing link 26 is retained on the back of bridge portion 24 by tape 50, as shown in FIGS. 6, 7, and 9. Tape 50 includes a pressure-sensitive adhesive backing 51, which bonds tape 50 to the back of bridge portion 24. Adhesive backing 51 and adhesive 31 are preferably an acrylic pressure-sensitive adhesive. Bridge portion 24 is sized to be about the same length as the insulative body 12. Thus, ends 28, 30 will contact ferrules 14, 15 when fuse 10 is assembled.

Referring now to FIGS. 3 through 9, fuse bridge portions 24 for multiple fuses are assembled on a bridge strip board 42 which is then stamped out into individual bridge portions.

Figure 3:
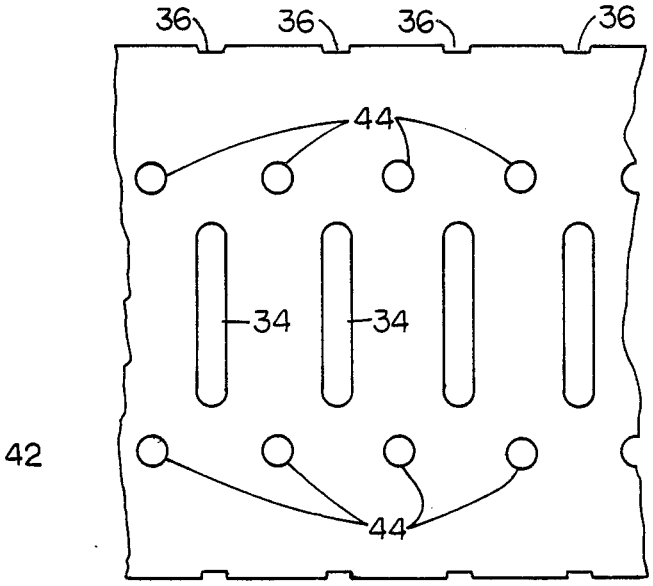
FIG. 3 is a rear view of a bridge strip board used in the manufacture of the bridge assembly shown in FIG. 2.

Referring particularly to FIG. 3, bridge strip board 42 is a sheet of thin insulative material, preferably fiber, about .03 inches thick, slightly wider than the length of insulative body 12, and one hundred to three hundred feet long. Bridge strip board 42 is preferably manufactured from a one hundred to three hundred foot coil of fiber stock which is punched to create spaced fusing gaps 34, notches 36, and die progression holes 44 therein. Where other materials, such as glass or ceramic, are employed as the bridge strip board 42 material, the bridge strip board will have to be pre-formed with progression holes 44, notches 36, and fusing gaps 34. Fusing gaps 34 and notches 36 are coaxially disposed in bridge strip board 42 at intervals to permit spaced punching of individual fuse bridges 16 from bridge strip board 42. Notches 36 are punched out of the edges 46 of bridge strip board 42. Die progression holes 44 are colinearly disposed equidistant adjacent fusing gaps 34. Die progression holes 44 are used to locate bridge strip board 42 during the assembly steps required to assemble fuse bridge 16.

Figure 4:
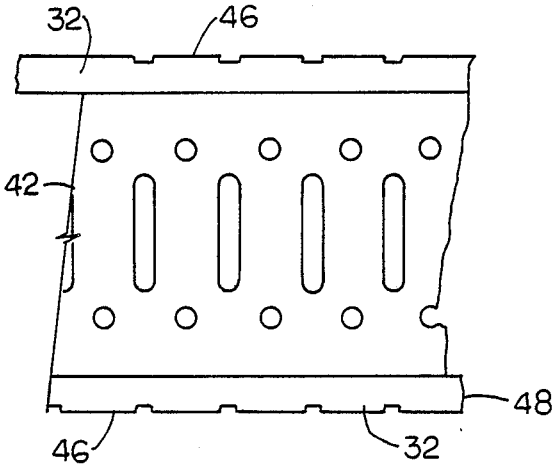
FIG. 4 is a rear view of the bridge strip board of FIG. 3 after the application of foil thereon.

Referring now to FIG. 4, metal foil 32 is applied to bridge strip board 42 along bridge board edges 46. Metal foil 32 is applied in the form of a thin foil ribbon 48 approximately 0.250 inches wide, having a pressure-sensitive adhesive 31, preferably an acrylic adhesive, on its back side. Ribbon 48 is laid on each edge 46, and folded over onto each side of the bridge strip board 42. Metal foil 32 is preferably knurled onto the surface of bridge strip board 42, which bonds metal foil 32 into contact with bridge strip board 42 through pressure-sensitive adhesive 31. The foil 32 may also be applied by other mechanical means, such as riveting or notching, or bridge strip board 42 may be supplied with metallized edges before punching. The metal foil 32 may be used only on one side if appropriate.

Figure 5:
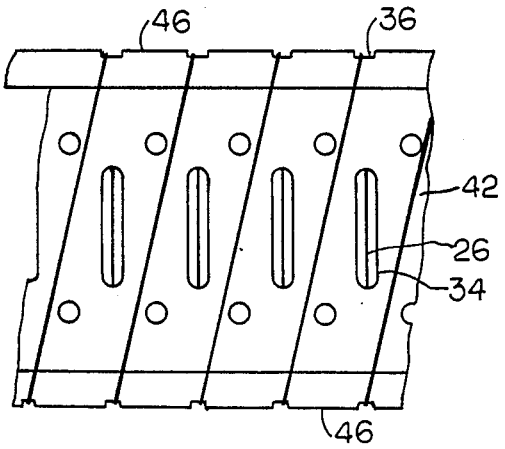
FIG. 5 is a rear view of the bridge strip board of FIG. 4 with the fuse wire coiled thereon.

Referring now to FIG. 5, fusing wire 26 is wound onto the bridge strip board 42. Wire 26 is laterally wound across one side of board 42 between adjacent coaxial notches 36, and then angularly disposed across the back face of board 42 into the next notch 36 on the opposite edge 46. Thus, a section of wire 26 is disposed longitudinally across fusing gaps 34. Wire 26 may be in multiple threads such that more than one fusing gap 34 is transversed on each winding pass. Further, dual or multi-strand fusing wire may be used.

Referring now to FIG. 6, the back or rear portion of bridge strip board 42 having the angularly disposed fusing wire 26 thereacross, is next coated with adhesive tape 50 across fusing wire 26 and metal foil 32. Tape 50 is a pressure-sensitive adhesive tape having adhesive 51 on one side which binds to fusing wire 26, metal foil 32, and bridge strip board 42 when pressure is applied to the tape 50.

Referring now to FIG. 7, tape 50 is sliced with a cutter which also cuts through fusing wire 26 and just into bridge strip board 42. A portion of the sliced tape 50 is peeled away from bridge strip board 42, thereby removing much of the diagonally disposed fusing wire 26 on the back side of bridge strip board 42 and leaving behind a portion of the tape 50 over metal foil 32 and fusing wire 26.

Figure 8:
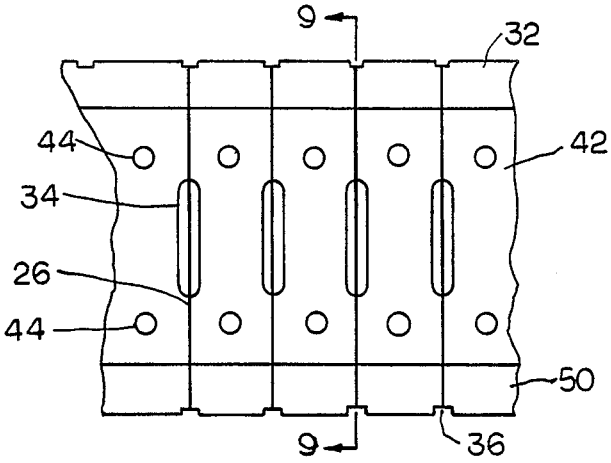
FIG. 8 is a front view of the bridge strip board of FIG. 7.

Referring now to FIGS. 8 and 9, the front of the bridge strip board 42 has the fusing wire 26 still disposed across adjacent fusing gaps 34. The excess fusing wire 26 disposed diagonally across the back of board 42 is eliminated by the cutting and peeling steps.

To form the fuse bridges 16, portions of bridge strip board 42 are stamped off in longitudinal sections. First, the bridge 16 is stamped from the board 42, and then a waste section, constituting the width of the board 42 corresponding to the die progress holes 44, is punched off.

It is contemplated that the fusing bridges 16 may be manufactured in a continuous process, wherein board 42 is unwound from a coil, and metal foil 32 is rolled and knurled onto edges 46. The wire 26 is then wrapped around bridge strip board 42 on an automatic wire winding machine. Tape 50 is rolled and pressed onto board 42, then sliced and the scrap wire 26 attached to the sliced portion of the tape 50 is peeled away. Finally, a die punches out individual fuse bridges 16.

Figure 10:
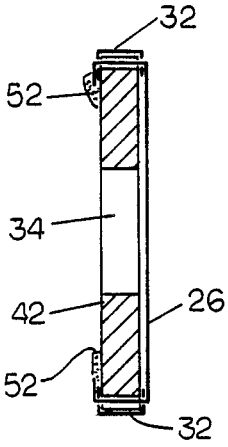
FIG. 10 is a section view of an alternative embodiment of the bridge strip board of FIG. 8 at section 9—9.

Referring now to FIG. 10, there is shown an alternative embodiment of the fuse bridge 16, wherein the paper tape 50 is replaced with an adhesive 52. Adhesive 52 may be placed over the individual fusing wires 26 encountered longitudinally down the length of bridge strip board 42, or a continuous strip of adhesive 52 may be laid in a line along the rear of bridge strip board 42. Adhesive 52 may be applied to the fusing wire 26 by means of an automatic dispenser or any other means including mechanical means of wire attachment such as rivets, clips or any other suitable material. After adhesive 52 hardens, bridge strip board 42 is passed under a cutting edge which cuts fusing wire 26 adjacent to adhesive 52. A finger (not shown) then removes the sliced fusing wire 26, leaving adhesive 52 attached to fuse wire 26 and bridge strip board 42. Individual fusing bridges 16 are then punched from bridge strip board 42 in a die.

To assemble the finished fuse 10, ferrules 14, 15 are precoated on their inner surfaces with solder 22, and ferrule 14 is located on one end of insulative body 12. A fuse bridge 16 is then located at the open end of insulative body 12 and dropped therein. The remaining ferrule 15, which is pre-coated with solder 22 on its inner surface, is then placed over the remaining open end of insulative body 12. Where the fuse 10 is rated for higher capacities, such as one-half amp and above, arc quenching fillers including but not limited to silica, calcium carbonates, aluminum sulfates, and calcium sulfates packed around fusing wire 26. The assembly is heated to cause the solder 22 to reflow to form a juncture between ferrules 14, 15, fusing wire 26, and metal foil 32. The metal foil 32 increases solder migration, thus creating a larger solder juncture than would be present with the fuse wire 26 alone.

The present invention has several advantages over the prior art. The use of metal foil 32 on the edges 46 of the fuse bridge 16 increases the surface area of the solder joint created at the ferrule-fusing wire interface. As the ferrules 14, 15 are heated to reflow the solder 22 thereon, solder 22 will migrate over the metal foil 32 and the adjacent fusing wire 26. Because the metal foil 32 presents a larger surface area than the fusing wire 26 alone, far greater migration occurs and a solder joint of greater area is formed. Further, the use of a fusing bridge 16 on low-amperage fuses eliminates the manufacturing step of placing holes in the end ferrules. Finally, the process may be automated for cost savings.

Although two embodiments of the present invention have been described, the invention may take form in other combinations or sub-combinations. For example, metal foil 32 may be located along only one edge 46 of fusing bridge 16. Likewise, those skilled in the art will recognize that other materials may be substituted without deviating from the scope of the invention.

We claim:

1. A fuse, comprising:
an insulating housing having opposed electrically conductive end caps;
a bridge having opposed ends disposed within said housing and extending between said end caps;
a fusing wire disposed on said bridge;
a metal foil disposed on at least one side of the ends of said bridge; and
solder connecting said fusing wire and metal foil to one of said end caps.

2. The fuse of claim 1, wherein said metal foil is adhesively bonded to said bridge.

3. The fuse of claim 1, wherein said bridge further includes a gapped portion over which said fusing wire passes.

4. The fuse of claim 3, wherein said gapped portion is a recess.

5. The fuse of claim 3, wherein said gapped portion is a through aperture.

6. The fuse of claim 1, wherein said ends of said bridge include notches therein for receiving said fusing wire.

7. The fuse of claim 1, wherein said fusing wire is held to one portion of said bridge by tape.

8. The fuse of claim 1, wherein said fusing wire is held to one of said ends of said bridge by an adhesive.

9. The fuse of claim 1 wherein said end caps are round ferrules.

10. The fuse of claim 1, wherein said foil is copper.

11. A fuse, comprising:
an insulating housing having opposed electrically conductive end caps;
an insulative bridge having opposed ends disposed in said housing and extending between said end caps;
a conductive foil adhesively disposed on at least one of said ends of said bridge;
a fusing wire disposed across said ends of said bridge; and
a solder connection between said fusing wire, said foil and said end cap.

12. The fuse of claim 11, wherein said bridge includes notches in said ends through which said fuse wire passes.

13. The fuse of claim 11, wherein said fuse wire is secured to said bridge by an affixing means.

14. The fuse of claim 13, wherein said affixing means is tape.

15. The fuse of claim 13, wherein said affixing means is an adhesive adhering said fusing wire to said bridge.

16. The fuse of claim 11, wherein said bridge includes a recess portion over which said fuse wire passes.

17. The fuse of claim 11, wherein said bridge includes a through hole over which said fuse wire passes.

18. The fuse of claim 11, wherein said foil is copper.

19. A fuse, comprising:
an insulative cylindrical body having opposed open ends;
an insulative bridge disposed in said body having opposed ends and a fusing gap therebetween;
a conductive copper foil bonded to said opposed ends;
a fusing wire disposed across said foil on said opposed ends;
opposed end caps disposed over said opposed open ends; and
a solder joint electrically interconnecting said foil, said fusing wire and said end caps.

20. A fuse, comprising:
an insulative housing having opposed open ends;
an insulative bridge member having opposed ends disposed in said housing;
a metallic foil disposed on at least one of said ends of said bridge member;
a single fusing link disposed across said ends of said bridge member;

end caps disposed on said open ends of said housing; and a solder connection between said end cap, said foil and said fusing link adjacent said open end of said housing.

21. The fuse of claim 20, wherein said metallic foil is copper.

22. The fuse of claim 20, wherein said metallic foil is bonded to said bridge member.

23. A fuse, comprising:

a body portion;

a bridge portion having opposed ends received within said body;

metal foil bonded to said opposed ends;

a single fusing link disposed across said bridge portion in contact with said metal foil on each of said opposed ends; and a conduction means for conducting electrical current to said fusing link located adjacent each opposed end and soldered to said fusing link and said metal foil adjacent said opposed ends.

24. The fuse of claim 23, wherein said body is cylindrical.

25. The fuse of claim 23, wherein said conduction means is an end ferrule.

* * * * *